US007447030B2

(12) United States Patent
Hwang et al.

(10) Patent No.: US 7,447,030 B2
(45) Date of Patent: Nov. 4, 2008

(54) THERMAL MODULE HAVING A HOUSING INTEGRALLY FORMED WITH A ROLL CAGE OF AN ELECTRONIC PRODUCT

(75) Inventors: Ching-Bai Hwang, Tu-Cheng (TW); Jie Zhang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 293 days.

(21) Appl. No.: 11/309,613

(22) Filed: Aug. 31, 2006

(65) Prior Publication Data

US 2008/0053642 A1 Mar. 6, 2008

(51) Int. Cl.
*H05K 7/20* (2006.01)
*F28F 7/00* (2006.01)

(52) U.S. Cl. ..... 361/700; 165/185; 165/104.33; 165/121; 165/122; 361/695

(58) Field of Classification Search ..... 165/104.33, 165/121, 122; 361/695, 700
See application file for complete search history.

(56) References Cited

U.S. PATENT DOCUMENTS 6,328,985 B1 * 12/2001 Sanduja et al. ..... 424/404
6,421,239 B1 * 7/2002 Huang ..... 361/696
6,681,845 B1 * 1/2004 Yeh et al. ..... 165/122
6,725,906 B2 * 4/2004 Lin et al. ..... 361/695
7,312,985 B2 * 12/2007 Lee et al. ..... 361/687
7,321,494 B2 * 1/2008 Han ..... 361/719
7,339,792 B2 * 3/2008 Han ..... 361/719
2002/0167799 A1 * 11/2002 Kawashima et al. ..... 361/700
2005/0225942 A1 * 10/2005 Lee ..... 361/700
2007/0006992 A1 * 1/2007 Liu et al. ..... 165/104.26
2007/0242436 A1 * 10/2007 Cheng et al. ..... 361/700
2007/0251677 A1 * 11/2007 Hwang et al. ..... 165/122
2008/0043436 A1 * 2/2008 Hung et al. ..... 361/700

* cited by examiner

*Primary Examiner*—Gregory D Thompson

(57) ABSTRACT

A thermal module includes a roll cage mounted to an enclosure of an electronic product, a centrifugal blower, and a fin assembly. The centrifugal blower is disposed in the roll cage and includes a housing integrally formed with the roll cage and defining an air outlet therein, a cover attached to the housing to cooperatively define a receiving chamber therebewteen, and a rotor rotatably disposed in the receiving chamber for producing an airflow. The fin assembly is disposed at the air outlet of the blower to perform heat convection with the airflow flowing therethrough.

12 Claims, 3 Drawing Sheets

THERMAL MODULE HAVING A HOUSING INTEGRALLY FORMED WITH A ROLL CAGE OF AN ELECTRONIC PRODUCT

CROSS-REFERENCES TO RELATED APPLICATION

This application is related to co-pending U.S. patent application Ser. No. 11/309,552, filed on Aug. 21, 2006, entitled "THERMAL MODULE" and assigned to the same assignee of the instant application. The disclosure of the above-identified application is incorporated herein by reference.

1. Field of the Invention

The present invention relates generally to a thermal module, and more particularly to a thermal module for dissipating heat generated by a heat-generating electronic component enclosed in a roll cage of an electronic product, wherein the thermal module has a centrifugal blower which has a housing integrally formed with the roll cage.

2. Description of Related Art

It is well known that heat is produced by electronic components such as integrated circuit chips during normal operation. If this heat is not quickly removed, these electronic components may overheat. Therefore, thermal modules are often used to cool these electronic components.

As an example, a thermal module in accordance with related art generally includes a fin assembly having a plurality of fins, a fan for creating an airflow through the fin assembly, and a heat pipe having an evaporating section which is kept in thermal contact with a heat-generating electronic component such as a central processing unit (CPU) of a computer, and a condensing section to which the fin assembly is attached. The heat pipe transfers heat generated by the heat-generating electronic component from the evaporating section to the condensing section of the heat pipe. The heat is then dissipated by the fin assembly into ambient atmosphere via the airflow flowing through the fin assembly.

Typically, most parts of the thermal module are individually mounted to a roll cage of an electronic product, for example, a notebook, via fasteners such as spring clamps or screws. For example, screws are generally required to mount a fan housing of the fan of the thermal module to the roll cage. It is a relatively awkward process to assemble the individual parts of the thermal module to the roll cage. Furthermore, in manufacture of the thermal module, separated molds are necessary in order to produce the individual parts of the thermal module, which increases the mold cost of the thermal module.

Therefore, it is desirable to provide a thermal module which can overcome the above-mentioned disadvantages.

SUMMARY OF THE INVENTION

The present invention relates to a thermal module for dissipating heat generated by a heat-generating electronic component. According to a preferred embodiment of the present invention, the thermal module includes a roll cage mounted to an enclosure of an electronic product, a centrifugal blower, and a fin assembly. The centrifugal blower is disposed in the roll cage and includes a housing integrally formed with the roll cage and defining an air outlet therein, a cover attached to the housing to cooperatively define a receiving chamber therebewteen, and a rotor rotatably disposed in the receiving chamber for producing an airflow. The fin assembly is disposed at the air outlet of the blower to perform heat convection with the airflow flowing therethrough.

Other advantages and novel features of the present invention will become more apparent from the following detailed description of preferred embodiment when taken in conjunction with the accompanying drawings, in which:

BRIEF DESCRIPTION OF THE DRAWINGS

Many aspects of the present thermal module can be better understood with reference to the following drawings. The components in the drawings are not necessarily drawn to scale, the emphasis instead being placed upon clearly illustrating the principles of the present thermal module. Moreover, in the drawings, like reference numerals designate corresponding parts throughout the several views.

DETAILED DESCRIPTION OF THE INVENTION

Figure 1:
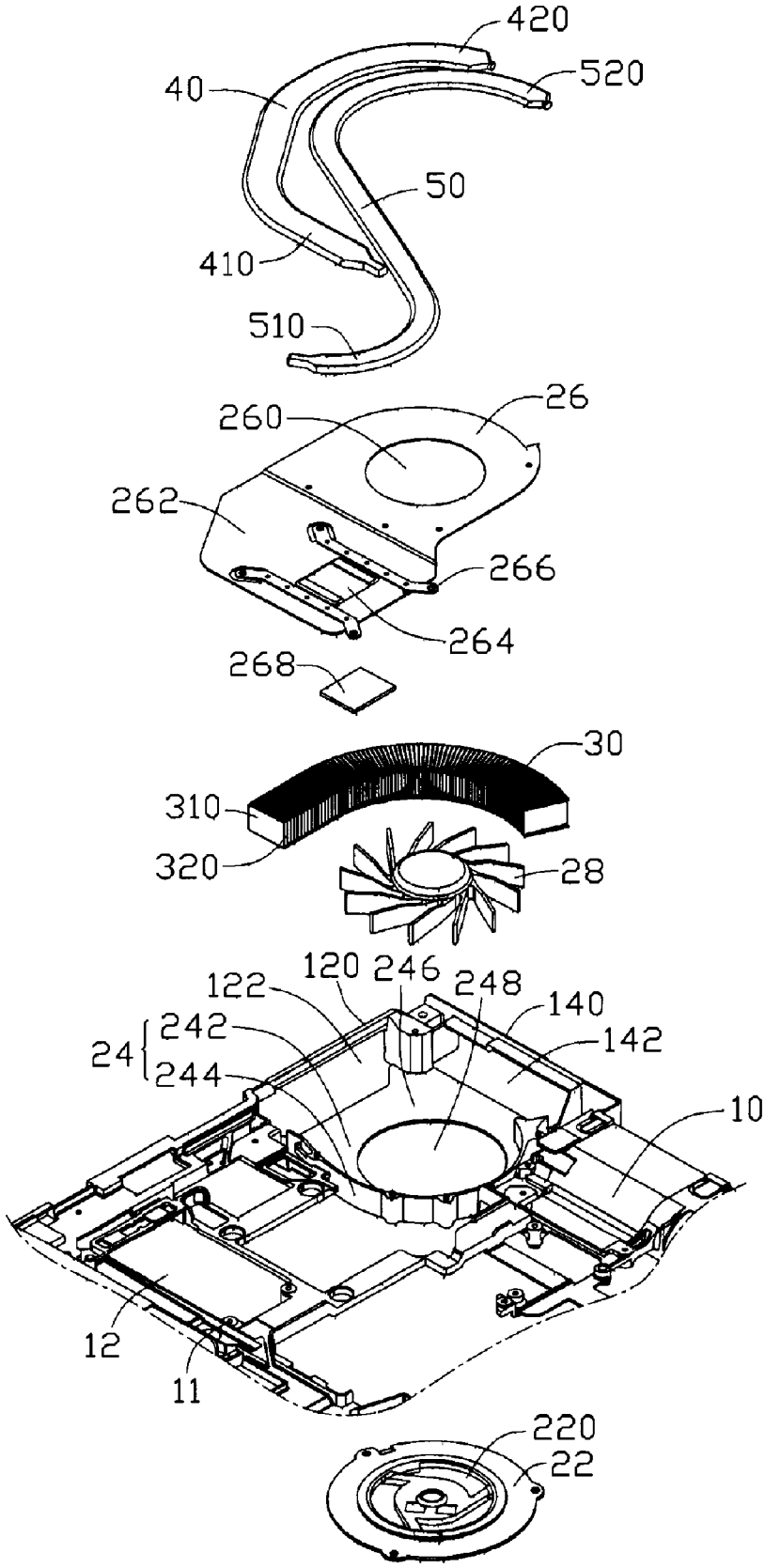
FIG. 1 is an exploded, isometric view of a thermal module in accordance with a preferred embodiment of the present invention.
Figure 2:
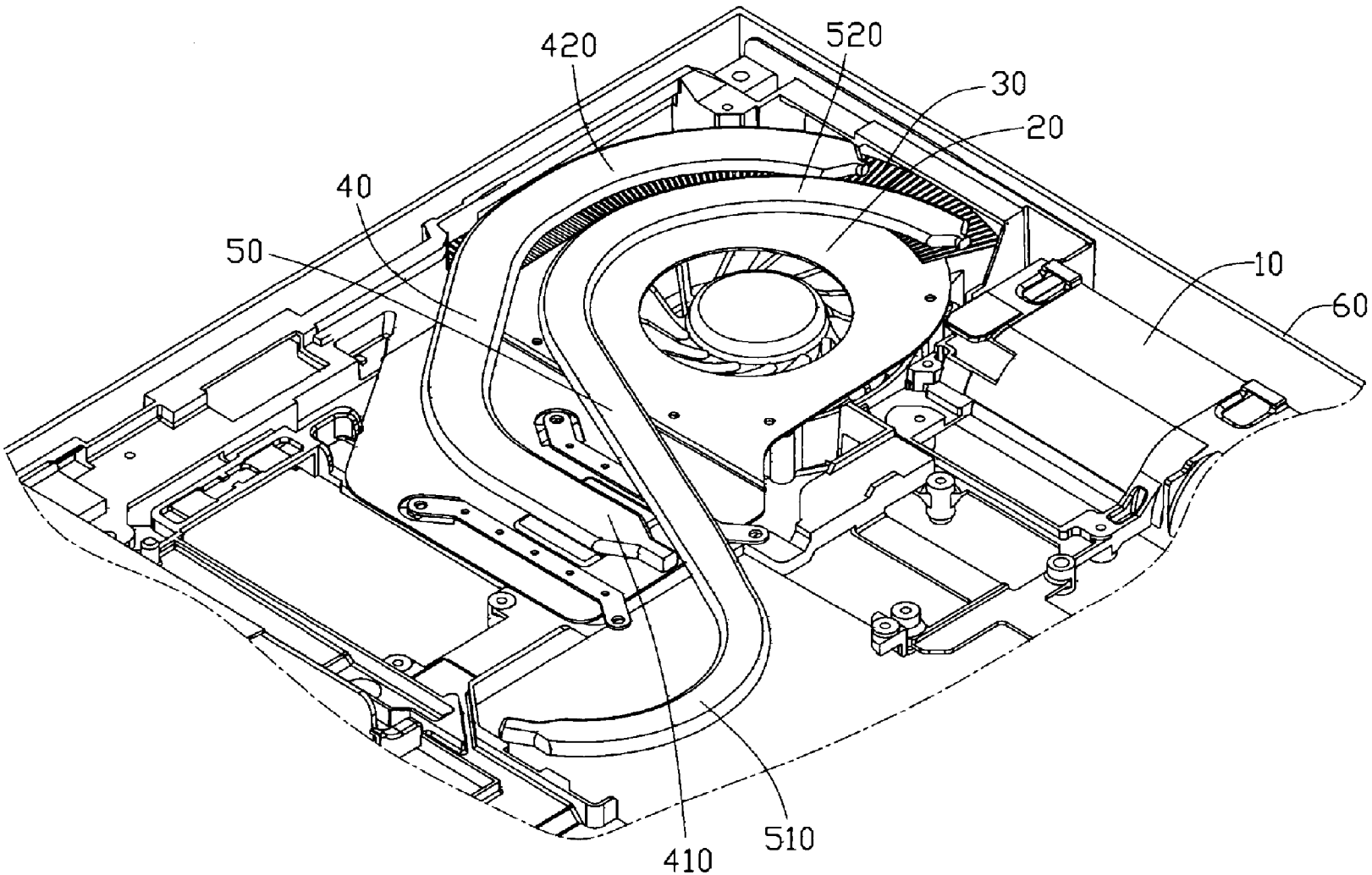
FIG. 2 is an assembled, isometric view of the thermal module of FIG. 1.
Figure 3:
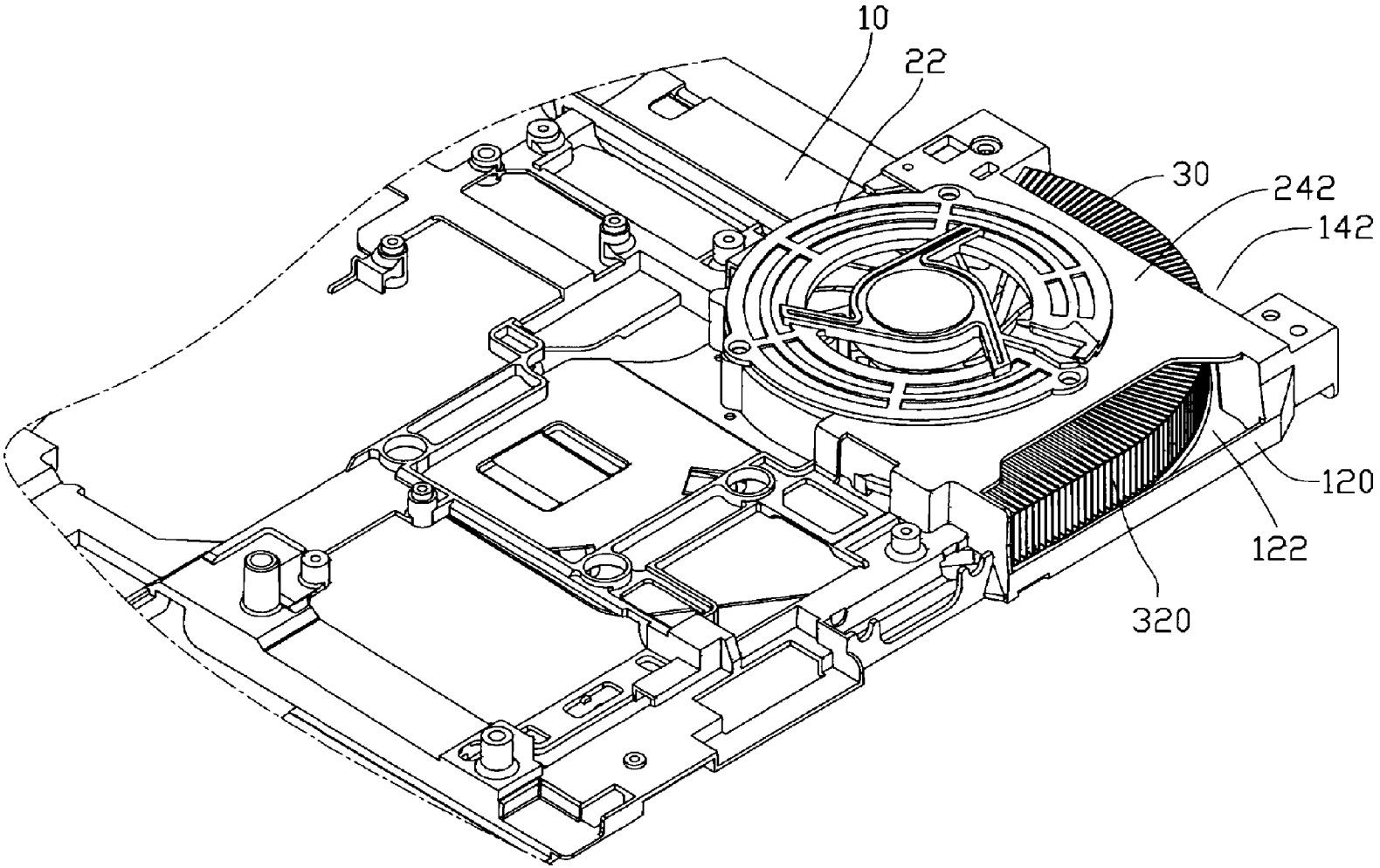
FIG. 3 is similar to FIG. 2, but viewed from another aspect.

Referring to FIGS. 1 to 3, a thermal module according to a preferred embodiment of the present invention is shown. The thermal module includes a roll cage 10, a centrifugal blower 20, an arc-shaped fin assembly 30, an arc-shaped heat pipe 40, and a serpentine heat pipe 50.

The roll cage 10 is a bracket attached to a system enclosure 60 of an electronic product (not shown). The electronic product in accordance with the preferred embodiment is a notebook. The roll cage 10 defines a plurality of holes 11 and cavities 12 therein, which receive the respective motherboard (not shown), hard disk (not shown), and other components of the notebook therein, preventing these components from being damaged by an external force exerted on the system enclosure 60.

The blower 20 is disposed on the roll cage 10, and includes a housing 24 integrally formed with the roll cage 10 as a single piece, a cover 26 attached to the housing 24 to cooperatively define a receiving chamber (not labeled) therebewteen, and a rotor 28 disposed in the receiving chamber. The housing 24 and the roll cage 10 are made of metallic materials having good thermal conductivity, such as magnesium alloy, aluminum alloy, or titanium alloy. Alternatively, the housing 24 and the roll cage 10 can be made of ABS engineering plastic, or carbon fiber. The housing 24 and the roll cage 10 are integrally formed as a monolithic piece by die-casting.

The housing 24 includes a base wall 242 and a periphery wall 244 perpendicularly surrounding the base wall 242. The base wall 242 defines an opening 248 at a middle portion thereof. A supporting portion 22 is mounted to a bottom face of the base wall 242 at the opening 248 for support of the rotor 28. The supporting portion 22 defines three apertures therein functioning as a first air inlet 220 of the blower 20. The periphery wall 244 defines an air outlet 246 near two adjacent sidewalls 120, 140 of the roll cage 10. The two sidewalls 120, 140 of the roll cage 10 each define a vent 122, 142 communicating the air outlet 246 of the blower 20 with the surrounding environment.

The cover 26 is disposed on the housing 24, and is made of material having good thermal conductivity, such as copper or aluminum alloy. Alternatively, the cover 26 can be made of ABS engineering plastic, or carbon fiber. The cover 26 defines a second air inlet 260 above the rotor 28. The cover 26 includes a planar plate 262 extending downwardly from a side of the cover 26 distant from the sidewall 140 of the roll cage 10. The planar plate 262 defines a rectangular-shaped opening 264 for receiving a heat spreader 268 therein. Two resilient plates 266 with through holes (not labeled) defined therein are disposed on the planar plate 262, adjacent to two opposite sides of the rectangular-shaped opening 264, respectively. The resilient plates 266 are used for mounting the planar plate 262 onto the roll cage 10 via screws (not shown) extending therethrough and engaging with the roll cage 10. The heat spreader 268 is accordingly attached to a heat-generating electronic component (not shown) below the planar plate 262 to absorb heat therefrom and transfers the heat to the heat pipe 40 thermally connected with the heat spreader 268.

The fin assembly 30 is located at the air outlet 246 of the blower 20, and includes a plurality of stacked fins 310. A plurality of air channels 320 is formed between pairs of adjacent fins 310 for passages of an airflow provided by the rotor 28 of the blower 20. The fin assembly 30 has two opposite surfaces thermally contacting with the respective base wall 242 of the housing 24 and the heat pipes 40, 50. The heat transferred to the heat pipes 40, 50 is transferred to the fin assembly 30 via phase change of working fluid filled in the heat pipes 40, 50, and dissipated to the surrounding environment via the heat convection between the fin assembly 30 and the airflow.

The heat pipes 40, 50 are flattened so as to increase the contacting areas with the heat spreader 268 and another heat-generating electronic component (not shown) and the fin assembly 30. The heat pipes 40, 50 each include an evaporating section 410, 510 being soldered to the heat spreader 268 or the another heat-generating electronic component, and a condensing section 420, 520 being attached to the fin assembly 30.

In assembly of the present thermal module, the rotor 28 of the centrifugal blower 20 is secured to the supporting portion 22, and accommodated in the receiving chamber formed between the cover 26 and the housing 24. The fin assembly 30 is disposed at the air outlet 246 of the centrifugal blower 20, with the air channels 320 of the fin assembly 30 communicating the air outlet 246 of the blower 20 with the vents 122, 142 of the sidewalls 120, 140 of the roll cage 10. The cover 26 is attached to the periphery wall 244 of the housing 24, with the heat spreader 268 disposed thereon and thermally contacting with the heat-generating electronic component. The heat pipes 40, 50 are mounted to the cover 26 of the blower 20, with the condensing sections 420, 520 and the evaporating sections 410, 510 thereof engaging with the fin assembly 30 and the heat spreader 268 and the another heat-generating electronic component, respectively. Finally, the assembled roll cage 10, centrifugal blower 20, fin assembly 30 and heat pipes 40, 50 are attached to the system enclosure 60 of the notebook.

During operation of the centrifugal blower 20, ambient cool air is inhaled into the housing 24 from the first and second air inlets 220, 260 of the centrifugal blower 20, and then flows towards the air outlet 246 and the fin assembly 30. The airflow then successively passes through the air channels 320 of the fin assembly 30 and the vents 122, 142 of the sidewalls 120, 140 of the roll cage 10, thus taking the heat away from the fin assembly 30 into the surrounding environment.

In the present thermal module, since the housing 24 of the centrifugal blower 20 is integrally formed with the roll cage 10, there is no need to use additional fasteners such as spring clamps or screws to secure the housing 24 of the centrifugal blower 20 to the roll cage 10. Thus, the thermal module can be assembled more easily. Furthermore, it is not necessary to provide individual molds for forming the housing 24 of the centrifugal blower 20 and the roll cage 10 separately, and as a result the mold cost of the present thermal module is reduced. Moreover, the roll cage 10 and the housing 24 are integrally formed by material having good thermal conductivity. The heat conveyed to the fin assembly 30 can be further transferred to the roll cage 10 and the housing 24. In this way, a part of the heat is dissipated into the surrounding environment via the fin assembly 30, and another part of the heat is dissipated via the roll cage 10 and the housing 24. Accordingly, the heat dissipating area of the thermal module is increased and the heat dissipation efficiency thereof is improved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A thermal module for use in an electronic product having an enclosure, comprising:

a roll cage defining a plurality of cavities for receiving different electrical components of the electronic product, being adapted for being mounted in the enclosure;

a centrifugal blower disposed in the roll cage and comprising a housing integrally formed with the roll cage as a monolithic piece and defining an air outlet therein, a cover attached to the housing to cooperatively define a receiving chamber therebewteen, and a rotor rotatably disposed in the receiving chamber for producing an airflow; and a fin assembly disposed at the air outlet of the blower to perform heat convection with the airflow flowing therethrough.

2. The thermal module of claim 1, wherein material for forming the roll cage is one of magnesium alloy, titanium alloy, aluminum alloy, ABS engineering plastic, and carbon fiber.

3. The thermal module of claim 2, wherein the roll cage is formed by die-casting.

4. The thermal module of claim 1, wherein the roll cage has two sidewalls each defining a vent therein communicating the air outlet of the blower with a surrounding environment.

5. The thermal module of claim 1, wherein the cover has a heat spreader thereon adapted for contacting with a heat-generating electronic component.

6. The thermal module of claim 5 further comprising a heat pipe having an evaporating section thermally connecting with the heat spreader and a condensing section thermally connecting with the fin assembly.

7. The thermally module of claim 6, wherein the fin assembly has an arc-shaped configuration.

8. The thermal module of claim 1, wherein the housing has a base wall and a periphery wall extending upwardly from the base wall, the cover being secured to the periphery wall, the base wall defining an opening, a supporting portion being attached to a bottom face of the base wall at the opening, the supporting portion supporting the rotor and defining a plurality of apertures therein.

9. An electronic product comprising:

an outer enclosure;

a roll cage mounted in the outer enclosure, wherein the roller cage defines a plurality of recesses adapted for accommodating electrical components of the electronic product and has an integrally formed base wall and a periphery wall extending upwardly from the base wall;

a cover mounted on the periphery wall to define a chamber between the cover, the periphery wall and the base wall;

a rotor rotatably mounted in the chamber, wherein when the rotor is rotated, an airflow is generated to flow through an air outlet near two adjacent sidewalls of the roll cage, each sidewall defining a vent communicating with the air outlet;

a fin assembly mounted at the air outlet; and a heat pipe having an evaporating section adapted for thermally connecting with a heat-generating electronic component of the electronic product and a condensing section thermally connecting with the fin assembly.

10. The electronic product of claim 9, wherein the fin assembly has an arc-shaped configuration and is at a lateral side of the rotor.

11. The electronic product of claim 10, wherein the evaporating section of the heat pipe is thermally connected with the heat-generating electronic component via a heat spreader attached to the cover.

12. The electronic product of claim 11, wherein each of the cover and the base wall defines an air inlet.

* * * * *